US007963136B2

(12) United States Patent
Flick et al.

(10) Patent No.: US 7,963,136 B2
(45) Date of Patent: Jun. 21, 2011

(54) PROCESS AND APPARATUS FOR THE CONTINUOUS PRODUCTION OF A THIN METAL STRIP

(75) Inventors: Andreas Flick, Linz (AT); Andreas Schweighofer, Linz (AT); Markus Brummayer, Aschach (AT); Gerald Hohenbichler, Kronstorf (AT); Gerald Eckerstorfer, Linz (AT)

(73) Assignee: Siemens Vai Metals Technologies GmbH & Co (AT)

( * ) Notice: Subject to any disclaimer, the term of this patent is extended or adjusted under 35 U.S.C. 154(b) by 634 days.

(21) Appl. No.: 11/577,297

(22) PCT Filed: Sep. 20, 2005

(86) PCT No.: PCT/EP2005/010129
§ 371 (c)(1),
(2), (4) Date: Dec. 27, 2007

(87) PCT Pub. No.: WO2006/042606
PCT Pub. Date: Apr. 27, 2006

(65) Prior Publication Data

US 2009/0049882 A1 Feb. 26, 2009

(30) Foreign Application Priority Data

Oct. 13, 2004 (AT) ..... A 1708/2004

(51) Int. Cl.
*B21B 37/28* (2006.01)

(52) U.S. Cl. ..... 72/11.7; 72/12.2; 72/200; 72/241.8; 29/527.7

(58) Field of Classification Search ..... 72/200, 72/202, 241.8, 7.1–14.7; 29/527.7; 164/428, 164/480, 476, 417, 451, 455, 154.7, 444, 486, 414
See application file for complete search history.

(56) References Cited

U.S. PATENT DOCUMENTS 5,133,205 A * 7/1992 Rostik et al. ..... 72/200
(Continued)

FOREIGN PATENT DOCUMENTS

DE 37 21 746 A1 1/1989
(Continued)

OTHER PUBLICATIONS

Second Office Action issued Nov. 28, 2008 in corresponding Chinese Application No. 200580035162.8 (English translation).

(Continued)

*Primary Examiner* — Dana Ross
*Assistant Examiner* — Matthew G Katcoff
(74) *Attorney, Agent, or Firm* — Ostrolenk Faber LLP

(57) ABSTRACT

Processes for continuous production of a thin metal strip, in particular a steel hot strip, directly from a metal melt and with a strip cast thickness of <10 mm by the roll-casting process. The cast metal strip is fed for in-line thickness reduction, and then to a storage device. To achieve a high-quality, hot-rolled metal strip with flatness tolerances comparable to those which can currently be achieved in the production of hot-rolled metal strip from continuous-cast thin slabs or slabs, at cast thicknesses of between 40 and 300 mm, in a continuous production process starting directly from metal melt. With the low strip cast thickness, a flatness measurement is performed on the moving metal strip, and the measurement results of this flatness measurement are used to influence the flatness of the metal strip in a targeted way.

22 Claims, 2 Drawing Sheets

U.S. PATENT DOCUMENTS

| | | | | |
|---|---|---|---|---|
| 6,006,574 | A * | 12/1999 | Armenat et al. | 72/201 |
| 6,158,260 | A * | 12/2000 | Ginzburg | 72/9.1 |
| 6,286,349 | B1 * | 9/2001 | Muller et al. | 72/11.7 |
| 6,314,782 | B1 * | 11/2001 | Stahl et al. | 72/241.8 |
| 6,327,883 | B1 * | 12/2001 | Noe et al. | 72/8.5 |
| 6,606,919 | B2 | 8/2003 | Perenon et al. | 73/862.3 |
| 2002/0080851 | A1 | 6/2002 | Faure et al. | 374/50 |
| 2002/0178840 | A1 | 12/2002 | Malard et al. | 73/862.3 |
| 2004/0079127 | A1 * | 4/2004 | Seidel | 72/12.5 |
| 2004/0129406 | A1 * | 7/2004 | Izu et al. | 164/480 |

FOREIGN PATENT DOCUMENTS

| | | | |
|---|---|---|---|
| EP | 108 379 | | 5/1984 |
| EP | 674 952 | | 10/1995 |
| JP | 06234048 | A * | 8/1994 |
| WO | WO 0158612 | A1 * | 8/2001 |
| WO | WO 01/94049 | A1 | 12/2001 |
| WO | WO 03/035291 | | 5/2003 |
| WO | WO 2004/009272 | | 1/2004 |

OTHER PUBLICATIONS

Lingke Zeng and Weiping Ye, Application of Computers in Materials Science and Engineering, pp. 54-57, Wuhan University of Technology Publish House, Mar. 2004 (English translation).

Jitang Ren, Theory and Practice of Continuous Casting and Continuous Rolling, pp. 61-63, Metallurgical Industry Publishing House, Jun. 2002 (English translation).

International Search Report PCT/EP2005/010129 dated Feb. 23, 2006.

* cited by examiner

PROCESS AND APPARATUS FOR THE CONTINUOUS PRODUCTION OF A THIN METAL STRIP

CROSS REFERENCE TO RELATED APPLICATIONS

The present application is a 35 U.S.C. §§371 national phase conversion of PCT/EP2005/010129 filed 20 Sep. 2005, which claims priority of Austrian Application No. A 1708/2004 filed 13 Oct. 2004. The PCT International Application was published in the German language.

BACKGROUND OF THE INVENTION

The invention relates to a process and an apparatus for the continuous production of a thin metal strip, in particular a steel hot strip, directly from a metal melt and with a strip cast thickness of <10 mm after a roll-casting process using a roll-casting device.

In particular, the invention relates to a process and an apparatus for producing a hot-rolled steel strip with a strip cast thickness of <6 mm. The hot strip thickness when the hot strip is stored following the rolling deformation is between 0.3 and 4 mm.

The proposed roll-casting processes on which the invention is based encompass all types of casting processes in which metal melt is solidified on the lateral surface of a casting roll so as to continuously form a metal strip. Both the single-roll casting process using a single-roll casting device and the vertical or horizontal two-roll casting process using a two-roll casting device are suitable for implementing the invention. It is also appropriate for the axes of the two interacting casting rolls to be arranged in a plane that is inclined obliquely with respect to the horizontal in order to implement the process according to the invention.

In a vertical two-roll casting process, metal melt is introduced into a melt space which is laterally delimited by two rotating casting rolls and associated side plates, with the axes of rotation of the casting rolls lying substantially in one horizontal plane. The two casting rolls with the associated side plates, including the necessary actuating and control devices, in this case form the core component of the two-roll casting device. The metal melt solidifies continuously at the lateral surfaces of the rotating, internally cooled casting rolls and forms strand shells which are moved with the lateral surfaces. In the narrowest cross section between the two casting rolls, the two strand shells are joined to form an at least substantially fully solidified metal strip. The cast metal strip is discharged at casting speed between the casting rolls and then fed for in-line thickness reduction in a rolling installation. Then, the rolled hot strip is fed to a storage device, in which it is stored. This process is preferably suitable for the production of steel strip, but it is also possible for metal strips made from aluminium or an aluminium alloy to be produced in this way. The basic principles of processes and installations of this type are already known, for example from WO 01/94049 or WO 03/035291.

To ensure further processing without any problems, flatness tolerances, which are in some cases defined in standards and in other cases are requested by customers according to the intended further processing, have to be maintained by the rolled hot strip. Experience gained in the production of hot-rolled steel strip has shown that it is very difficult to satisfy these requirements when using the two-roll casting process on a corresponding casting installation.

Standard values for the flatness of thin hot strip are defined in standards (e.g. DIN 10051) and for rolled hot strip have values of from 20 to 30 I units for the thickness range described in the introduction.

One major cause of difficulties in achieving standard flatness values results from the high production speed with the production process selected for the cast intermediate product. The metal strip is produced in a process with extremely high solidification rates directly in a format with extreme width/thickness ratios, which although eliminating a large number of roll passes with a view to achieving the desired hot strip final thickness, means that width-independent, uniform convective heat transfer or liquid metal temperature at the solidification front (when forming the strand shells) are only possible to a limited extent, on account of the highly turbulent flow conditions in the metal bath. This results in a temperature/width profile on the cast metal strip when it emerges from the casting nip between the casting rolls which is subject to fluctuations of up to 100% and above, based on the supercooling with respect to the equilibrium solidus temperature, so that internal stress conditions and creep properties which cause unevenness in the cast strip are present. Unevenness which lies outside the hot strip standard is produced even if the fluctuation is only in a range from 30-40%.

The in-line rolling of a cast metal strip can also contribute to the formation of further unevenness if the strip inlet temperature (temperature at which the metal strip enters the rolling stand) is relatively uneven over the width of the metal strip or the inlet strip profile is unknown or fluctuates. This results in variable deformation properties in the roll nip as a result of different spring properties or roll nip profiles transversely with respect to the rolling direction.

When it first enters a rolling stand, the cast metal strip has an entry microstructure with a cast structure which with a low reduction per pass is converted into a more fine-grained rolled microstructure, in order to achieve the materials properties which are favourable for the respective further processing steps. At the same time, the starting thickness upstream of the rolling stand is less than 10 mm, preferably less than 6 mm. At the low starting thicknesses preferred, it is not possible to influence the relative strip profile without any flatness defects. Furthermore, the high roughness of the metal strip, caused by the casting operation and by any scaling, leads to a high level of wear to the working rolls. These wear phenomena on the working rolls occur to an increased extent in the region of the strip edges and lead to defects in the strip profile. In this context, apart from the strip thickness and the temperature level, the wear phenomena are also influenced to a considerable extent by the strip material, the strip profile and the thermal profile.

SUMMARY OF THE INVENTION

Therefore, it is an object of the present invention to avoid these drawbacks which have been described and to propose a process and an apparatus with which it is possible to produce a high-quality, hot-rolled metal strip having a comparable profile of properties, in particular with regard to the desired flatness tolerances, to those which can currently be achieved in the production of hot-rolled metal strip, in particular steel strip, from continuous-cast thin slabs or slabs, at cast thicknesses of between 40 and 300 mm, using rolling devices corresponding to the prior art, according to the invention in a continuous production process starting directly from metal melt and a strip cast thickness of less than 10 mm.

The comparable profile of properties of a high-quality hot-rolled metal strip encompasses in particular:

the homogeneity of the metal strip produced, in particular the mechanical properties of the metal strip in the transverse and longitudinal directions and throughout the entire production, the achievement of flatness values similar to the values which are currently prescribed and can be achieved in practice for hot strip, if appropriate after passing through a cold strip manufacturing line, a surface appearance and roughness values close to those which can be achieved in conventional production processes, compliance with geometric demands relating to further surface-treating or shaping processing steps.

In a process of the type described in the introduction, this object is achieved by virtue of the fact that a flatness measurement is performed on the moving metal strip, and the flatness measured values from this flatness measurement are used to influence the flatness of the metal strip in a targeted way. The influencing of the flatness of the metal strip may in this case take place either during the formation of the metal strip between the lateral surfaces of the two casting rolls or during the in-line thickness reduction by way of a control circuit or alternatively by manual intervention. The flatness measurement is carried out over the distance between the roll-casting device, formed by at least one casting roll, and the storage device, in a plane which is transverse with respect to the strip-running direction.

The in-line thickness reduction of the metal strip is carried out in at least one deformation stage in an at least single-stand rolling installation, and the flatness measurement is carried out before or after at least one of these deformation stages, preferably immediately after the first deformation stage.

According to a preferred embodiment, the flatness measurement is carried out by determining the stress distribution in the metal strip in a plane lying transversely with respect to the conveying direction.

It is expedient for the measured values from the flatness measurement to be used to influence the roll nip in at least one rolling stand of the rolling installation. The measured flatness values, which may have been processed in a central processing unit, are used for closed loop flatness control, in which components of the rolling stand, or devices mounted substantially directly upstream of the rolling stand, are used to influence the roll nip and/or to influence state variables of the metal strip. The roll nip in the rolling stands is influenced by at least one of the following measures:

working roll bending, working roll displacement, at least zonal thermal influencing of the roll barrel or of the working rolls.

Equally, the measured values from the flatness measurement can be used for at least zonal thermal influencing of the metal strip.

Another way of generating control signals for the flatness control circuit from the flatness measured values is to use the measured values from the flatness measurement to influence the surface profile of the at least one casting roll.

In addition to the flatness measurement, a further improvement of the flatness tolerances on the hot strip produced is achieved by virtue of the fact that a temperature profile of the metal strip is determined in a plane lying transversely with respect to the conveying direction of the metal strip at least before or after the rolling installation, and the measured temperature profile is used to influence the flatness of the hot strip in a targeted way.

Local temperature deviations in the hot strip which occur in longitudinally oriented zones can be specifically influenced if the temperature distribution in the metal strip is influenced in sections in a plane lying transversely with respect to the conveying direction of the metal strip as a function of the measured temperature profile. The more independently controllable cooling or heating zones are arranged transversely with respect to the strip running direction, the better the temperature profile can be controlled at the cast metal strip.

Another way of making the flatness of the metal strip more uniform consists in additionally measuring the strip thickness profile in a plane lying transversely with respect to the conveying direction of the metal strip, and using the measured strip thickness profile to influence the flatness of the hot strip in a targeted way.

The invention is preferably employed in the production of a metal strip using the two-roll casting process, in particular the vertical two-roll casting process, in which case a flatness-measuring device for recording flatness measured values of the metal strip is arranged between the roll-casting device and the storage device, and the flatness-measuring device is assigned an evaluation device for recording and converting the flatness measured values determined.

The object according to the invention is also achieved by an apparatus for the continuous production of a thin metal strip, in particular a steel hot strip, directly from a metal melt and having a strip thickness of <10 mm, having a roll-casting device, having an at least single-stand rolling installation arranged downstream and having a storage device for storing the rolled metal strip, if a flatness-measuring device for recording flatness measured values of the metal strip is arranged between the roll-casting device and the storage device, and if the flatness-measuring device is assigned an evaluation device for recording and converting the flatness measured values.

Expediently, the flatness-measuring device for recording flatness measured values is arranged in a plane which is transverse with respect to the conveying direction of the metal strip.

Preferably, the flatness-measuring device is arranged upstream or downstream of a rolling stand of an at least single-stand rolling installation. In the case of a multi-stand rolling mill train, the flatness-measuring device is arranged upstream or preferably downstream of the first rolling stand.

The flatness measurement can be carried out using various flatness-measuring devices which are commercially available. Measuring devices of this type are mostly known for determining flatness values from cold strip production, and consequently suitable adaptations with regard to thermal stability and measurement accuracy at high temperatures are required for the specific application of hot strip at rolling temperature. For flatness measurement in the hot region, the flatness-measuring device is preferably formed by a flatness-measuring roller, a device for optically recording shape or a device for recording other inhomogeneities in strip surface properties. In the case of flatness measurement using a flatness-measuring roller, the metal strip is generally under strip tension, which is taken into account during evaluation of the measurement results in the evaluation device. In the case of optical recording of the shape of the metal strip, the metal strip must not be under strip tension if good measurement results are to be achieved. Flatness-measuring devices which are employed in conventional cold-rolling and hot-rolling devices are already known from DE 3721 746 A1, U.S. Pat. No. 6,606,919 B2, US 2002/0178840 A1 and US 2002/0080851 A1, where their structure is described in detail.

The evaluation device, preferably a central processing unit, is connected, via signal lines for transmitting control variables, to at least one of the following actuating devices for influencing the roll nip in the rolling stands:

- a bending block for working roll bending,
- a working roll displacement device,
- a heating/cooling device for zoned direct or indirect thermal influencing of the roll barrel,
- a heating/cooling device for at least zoned thermal influencing of the metal strip.

As an alternative or in addition, the evaluation device is connected via signal lines to at least one of the following actuating devices for influencing the surface profile of the at least one casting roll:

- a heating/cooling device for zoned direct or indirect thermal influencing of the casting roll barrel,
- preferably hydraulically actuable deformation device at the casting roll for applying radially acting deformation forces,
- a gas purge device for zoned influencing of the strand shell solidification conditions at the casting roll barrel,
- a coating device for zoned coating of the casting roll barrel with a coating agent which influences the heat transfer or the nucleation density in order to influence the strand shell solidification conditions,
- a cleaning device for zoned cleaning of the casting roll barrel for zoned influencing of the strand shell solidification conditions at the casting roll barrel.

To achieve flatness values in a very narrow tolerance range, a temperature-measuring device for recording the temperature profile of the metal strip is additionally arranged just in front of or just behind at least one rolling stand of the rolling installation, in a plane which lies transversely with respect to the conveying direction of the metal strip, and this temperature-measuring device is assigned an evaluation device for recording and converting the measured values. This temperature measurement should be carried out at a short distance, preferably immediately, upstream of the first rolling stand, in order for the conditions in the rolling nip to be reproduced as accurately as possible.

Expediently, the temperature-measuring device is arranged upstream of the rolling installation, and the evaluation device is connected, via signal lines for transmitting control variables, to a strip-heating device or strip-cooling device, in order to make the temperature profile more uniform.

Another possible way of minimizing flatness deviations on the hot strip consists in the fact that a strip thickness profile measuring device for determining the strip thickness profile is arranged in a plane lying transversely with respect to the conveying direction of the metal strip, and this strip thickness measuring device is assigned an evaluation device for recording and converting the measured values.

The evaluation device is connected, via signal lines for transmitting control variables, to at least one of the following actuating devices for influencing the strip thickness profile in the rolling stands:

- a working roll adjustment device,
- a bending block for working roll bending,
- a working roll displacement device,
- a heating/cooling device for zoned direct or indirect thermal influencing of the roll barrel.

Furthermore, the evaluation device may be individually connected, via signal lines, to at least one of the following actuating devices for influencing the strip thickness profile by means of the at least one casting roll:

- a casting roll adjustment device,
- a heating/cooling device for zoned thermal influencing of the casting roll barrel,
- preferably hydraulically actuable deformation device at the casting roll for applying radially acting deformation forces,
- a gas purge device for zoned influencing of the strand shell solidification conditions at the casting roll barrel,
- a coating device for zoned coating of the casting roll barrel with a coating agent which influences the heat transfer or the nucleation density in order to influence the strand shell solidification conditions,
- a cleaning device for zoned cleaning of the casting roll barrel for zoned influencing of the strand shell solidification conditions at the casting roll barrel.

The measurement results of the flatness measurement, or alternatively of a number of flatness measurements along the production line, can be used for influencing the flatness of the metal strip in a targeted way exclusively in at least one rolling stand or exclusively in the roll-casting device, or alternatively in combination on both these devices. In addition, it is also possible to influence the flatness of the metal strip by means of associated devices, such as for example a strip-heating device.

The roll-casting device is preferably designed to implement the two-roll casting process in accordance with the invention and comprises two casting rolls driven in rotation and two side plates, which together form a melt space for holding metal melt and a casting gap for forming the cross-sectional format of a cast metal strip.

The implementation of the process according to the invention as described above in a semi-industrial test installation has managed to reduce the flatness deviations by up to 50% even after just a few tests.

BRIEF DESCRIPTION OF THE DRAWINGS

Further advantages and features of the present invention will emerge from the following description of figures illustrating non-limiting exemplary embodiments, in which reference is made to the appended figures in which.

DESCRIPTION OF PREFERRED EMBODIMENTS

Figure 1:
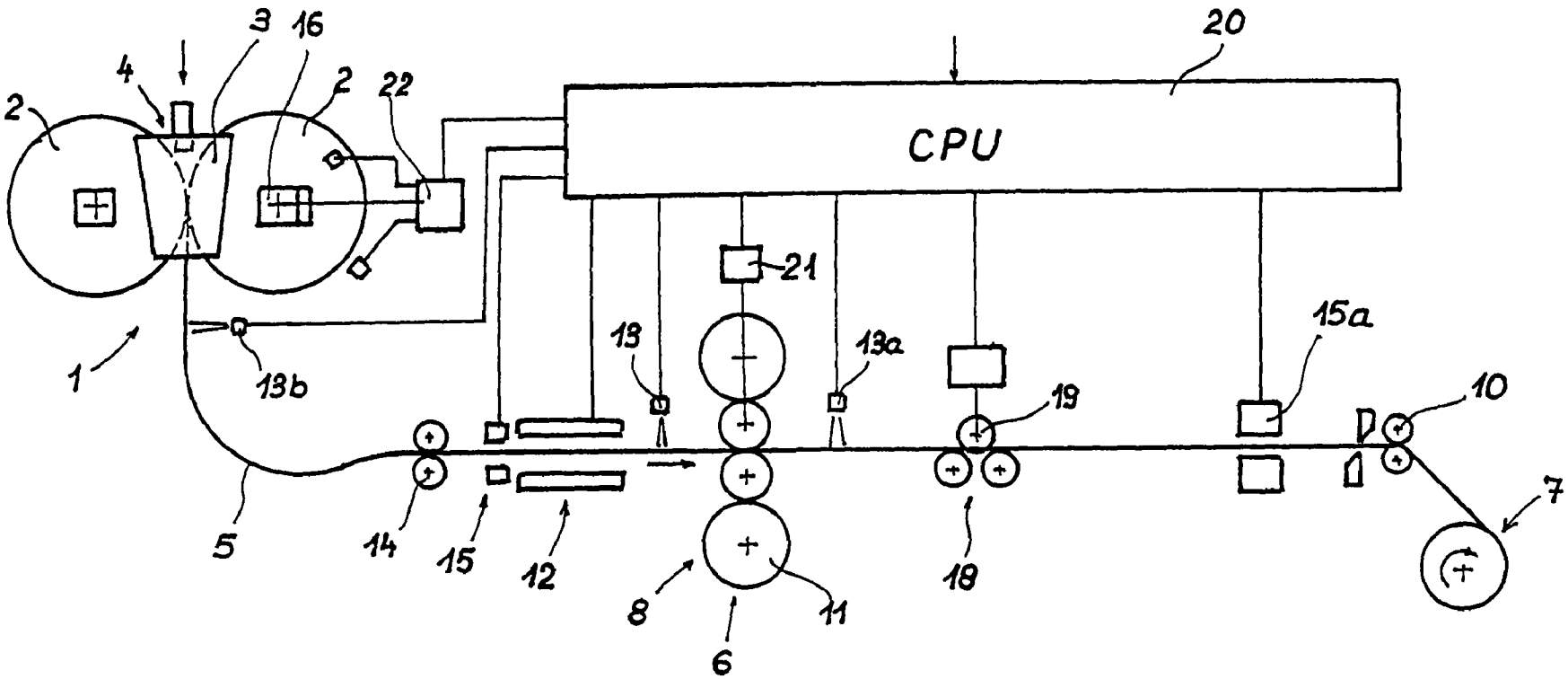
FIG. 1 shows a production installation according to the invention for producing thin hot strip, having a two-roll casting device and a single-stand rolling installation, including a flatness-measuring device.
Figure 2:
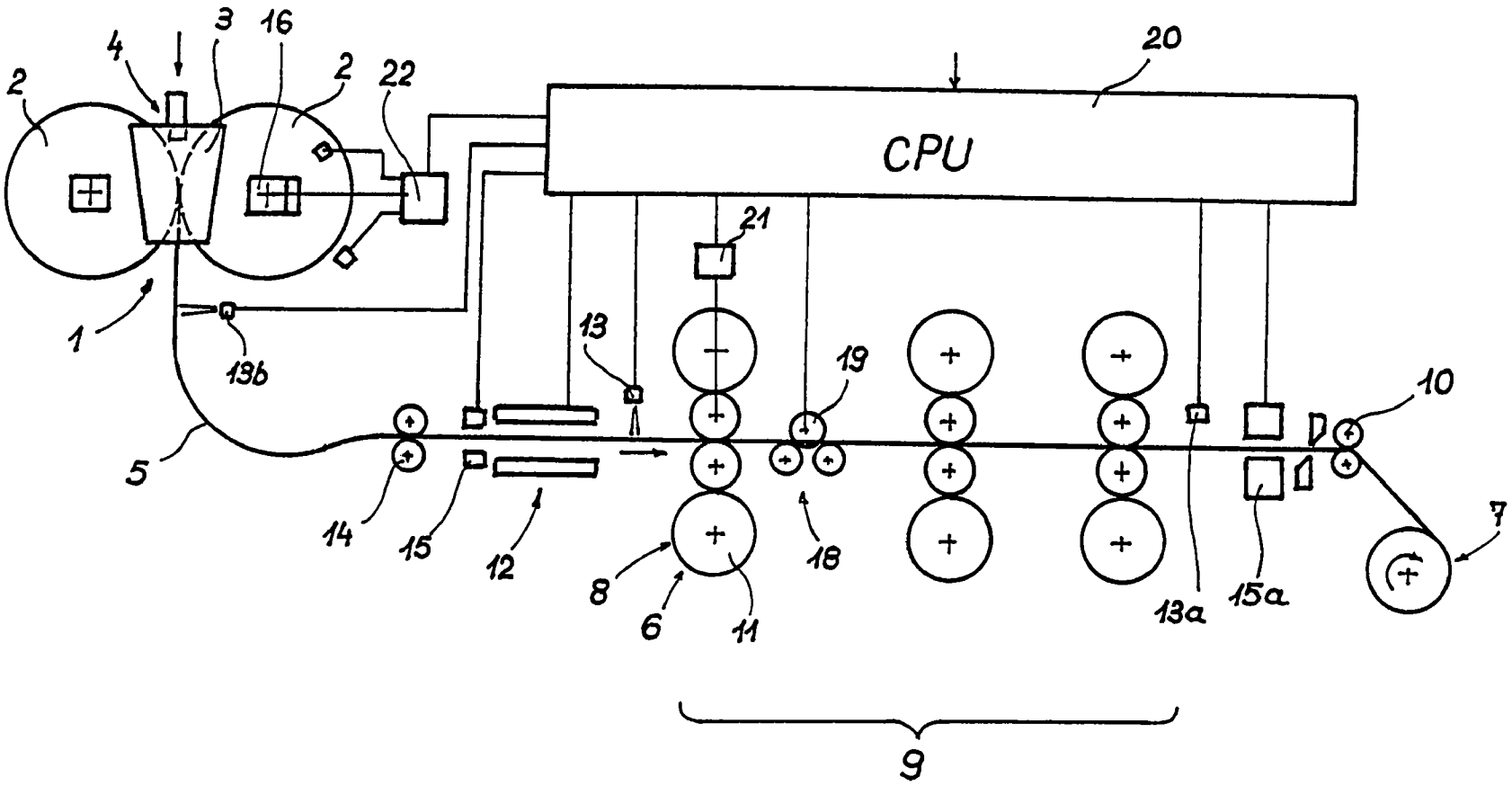
FIG. 2 shows a production installation according to the invention for thin hot strip having a two-roll casting device and a multi-stand rolling installation, including a flatness-measuring device.

FIGS. 1 and 2 illustrate two embodiments of an installation for producing a steel hot strip in the form of a diagrammatic longitudinal section comprising the main components of the installation, as well as measurement and control devices for the production of a thin hot strip within the flatness tolerances which are customary for thin hot strip. The basic structure of the installation is the same when producing a nonferrous metal strip.

In a two-roll casting device 1, steel melt is introduced into a melt space 4, which is formed by two internally cooled, oppositely rotating casting rolls 2 and two side plates 3 positioned at the end sides of the casting rolls, and a cast steel strip 5 with a predetermined cross-sectional format is discharged vertically downwards from a casting gap formed by the casting rolls 2 and the side plates 3. After the steel strip has been diverted into a horizontal conveying direction, the cast steel strip is subjected to a reduction in thickness and change in microstructure in a rolling installation 6 and then fed to a storage device 7. Depending on the steel grade, casting thickness and final thickness of the hot strip, the rolling installation 6 is designed as a single-stand rolling installation 8 (FIG. 1), for example for strip steel with low quality requirements, or as a multi-stand rolling mill train 9 (FIG. 2), for example for the production of high-quality steel grades with a greater degree of reduction and with particular demands imposed on surface quality and deformation properties. The storage device 7 comprises a coiler for winding the hot strip into coils and may also be integrated in a coiling furnace. A strip driver 10 for setting a strip tension during coiling and strip shears are mounted upstream of the storage device.

To set a constant rolling temperature upstream of the first rolling stand, the steel strip passes through a strip-heating device 12 which is mounted upstream of the first rolling stand 11 and may also comprise a cooling device. The strip-heating device 12 allows zoned influencing of the temperature of the steel strip transversely with respect to the strip-running direction, for example increased heating of the strip edges if excessive cooling has already occurred in this region. A temperature-measuring device 13, which is used to continuously record the strip temperature in a plurality of zones in a plane located transversely with respect to the strip-running direction and to control the strip-heating device 12, is mounted directly upstream of the first rolling stand 11. The strip driver 14 keeps the steel strip under strip tension, and if appropriate also centres it, in the strip-heating device 12 and as far as the first rolling stand 11. A strip thickness profile measuring device 15 measures the strip thickness of the cast steel strip leaving the two-roll casting installation, this strip thickness being preset using a casting-roll control device 16 or corrected according to the measurement results.

A flatness-measuring device 18, which is used to record the flatness profile on the steel strip in a plane transverse with respect to the strip-running direction is arranged a short distance downstream of the first and only rolling stand 11 in the embodiment shown in FIG. 1 and the first rolling stand 11 in the embodiment shown in FIG. 2. Flatness deviations result either from thickness deviations over the strip width or from waviness in the strip. The flatness-measuring device 18 comprises a flatness-measuring roller 19 adapted for use at hot temperatures. A flatness-measuring roller as can be used according to the invention is described in detail in U.S. Pat. No. 6,606,919 B2. The corresponding measuring method for determining flatness deviations is described in Application US 2002/0178840 A1 and can also be employed here. The measured values determined are fed to an evaluation device 20, which is formed by a central processing unit (CPU), where the measurement signals are evaluated and control signals which counteract the flatness deviations are transmitted to actuating devices 21 of the first rolling stand 11 and/or to actuating devices 22 of the two-roll casting device 1.

The possible actuating devices 21 of the first rolling stand are devices which are available as standard with conventional rolling stands. The actuating device 21 may comprise a bending block for working roll bending of, for example, cylindrical working or supporting rolls, or a working roll displacement device for the axial displacement of contoured working or supporting rolls. Furthermore, heating and cooling devices for zoned thermal influencing of the roll barrel of the working rollers also constitute possible actuating devices.

In subregions, flatness deviations or thickness profile deviations occur on the steel strip as early as during the formation of the steel strip in the two-roll casting device. At the low strip cast thickness, these deviations can no longer be eliminated, or only a small proportion of them can be eliminated by the subsequent roll passes. In particular, the thickness profile deviations which are produced during the formation of the steel strip can lead to flatness deviations during the roll passes. It is therefore expedient to intervene in the strip profile formation by means of an actuating device 22 directly at the two-roll casting device 1 by means of closed-loop control based on the measured flatness values. Possible actuating devices 22 for influencing the surface profile of the casting rolls at the two-roll casting device include a heating and/or cooling device for zoned direct or indirect thermal influencing of the external shape of the casting roll barrel, preferably hydraulically actuable deformation devices at the casting rolls for applying radially acting deformation forces to the casting roll lateral surface, a gas purge device for zoned influencing of the strand shell solidification conditions at the casting roll barrels, a coating device for zoned coating of the casting roll barrels with a coating agent which influences heat transfer in order to influence the strand shell solidification conditions, or alternatively a cleaning device for zoned cleaning of the casting roll barrels for zoned influencing of the strand shell solidification conditions at the casting roll barrels.

An expedient control for minimizing the flatness deviations may consist in monitoring and influencing both the profile formation during the casting process in the two-roll casting device and the profile formation or change in the first roll pass in the first rolling stand. This can be done solely by means of suitable evaluations in the evaluation device or by including a further flatness-measuring device upstream of the first rolling stand.

Temperature profiles over the strip width, recorded by the temperature-measuring devices 13, 13*a*, 13*b*, and strip thickness profiles recorded using the strip thickness profile measuring devices 15, 15*a* can be input into a mathematical model in the evaluation device in addition to the flatness values, so that the mathematical model develops an optimum control strategy and generates corresponding control signals.

The temperature profile of the cast metal strip can be recorded immediately after the strip has been formed using the temperature-measuring device 13*b*, which is arranged at a distance below the two casting rolls 2. This temperature profile allows conclusions to be drawn as to the strand shell formation at the roll barrel of the casting rolls and the solidification or temperature conditions prevailing at the time. Taking this temperature profile into account makes it possible, when evaluating the flatness measured values in the evaluation device, to generate control variables which are more accurately matched to the strip formation conditions, in particular for controlling the actuating devices 22 at the two-roll casting device.

The measures which have been described in connection with a vertical two-roll casting device can equally be transferred to a single-roll casting device. It is preferable for a smoothing roll for conditioning the free strip surface to be assigned to the casting roll of the single-roll casting device, and the actuating devices for influencing the flatness can be assigned both to the casting roll and to the smoothing roll.

The invention claimed is:

1. A process for the continuous production of a thin metal strip directly from a metal melt and with a strip cast thickness of <10 mm after a roll-casting process, the method comprising applying a metal melt to a lateral surface of at least one rotating casting roll for forming a metal strip, feeding the metal strip at a casting rate for in-line thickness reduction by at least one deformation stage having an at least single-stand rolling installation, then feeding the metal strip to a storage device and storing the strip in the storage device, performing a flatness measurement on the moving metal strip before or after the at least one deformation stage, and using the flatness measured values from the flatness measurement to selectively influence a surface profile of the metal strip in a direction transverse to a conveying direction of the metal strip, wherein the metal strip is held under strip tension and is centered as far as the rolling installation.

2. The process according to claim 1, wherein the flatness measurement is performed immediately after the first or only deformation stage.

3. The process according to claim 1, wherein the flatness measurement comprises determining the stress distribution in the metal strip in a plane lying transversely with respect to a conveying direction of the strip being measured.

4. The process according to claim 1, further comprising using the flatness measured values from the flatness measurement to influence a roll nip in at least one rolling stand of the rolling installation.

5. The process according to claim 4, further comprising influencing the roll nip in the at least one rolling stand by at least one of the following measures:

working roll bending, working roll displacement, at least zonal thermal influencing of the roll barrel, at least zonal thermal influencing of the working roll, and at least zonal thermal influencing of the metal strip.

6. The process according to claim 1, further comprising using the flatness measured values from the flatness measurement to influence the surface profile of the casting roll.

7. The process according to claim 1, further comprising determining a temperature profile of the metal strip in a plane lying transversely with respect to a conveying direction of the metal strip just before or after the rolling installation, and using the measured temperature profile to selectively influence the flatness of the hot strip.

8. The process according to claim 1, further comprising influencing the temperature distribution in the metal strip in sections in a plane lying transversely with respect to a conveying direction of the metal strip as a function of the measured temperature profile of the strip.

9. The process according to claim 1, further comprising measuring the strip thickness profile in a plane lying transversely with respect to a conveying direction of the metal strip, and using the measured strip thickness profile to selectively influence the flatness of the hot strip.

10. The process according to claim 1, wherein a roll-casting process is implemented as a vertical two-roll casting process, comprising introducing metal melt into a melt space delimited by rotating casting rolls and side plates, permitting the metal melt to continuously solidify on the lateral surfaces of the casting rolls to run with the rolls, in the form of strand shells, joining the strand shells at the narrowest cross section between the casting rolls to form an at least substantially fully solidified metal strip, and discharging the metal strip at a casting speed between the casting rolls.

11. Apparatus for the continuous production of a thin metal strip directly from a metal melt and having a strip thickness of <10 mm, the apparatus comprising a roll-casting device having an at least single-stand rolling installation arranged downstream and having a storage device for storing the rolled metal strip after the casting device in a conveying direction of the strip, a flatness-measuring device arranged upstream or downstream of a rolling stand of the at least single-stand rolling installation operable for recording flatness measured values of the metal strip and arranged between the roll-casting device and the storage device, an evaluation device for the flatness-measuring device for recording and converting the flatness measured values an actuating device for influencing a surface profile of the metal strip in a direction transverse to a conveying direction of the metal strip responsive to the flatness measured values of the metal strip, and a strip driver operable to keep the steel strip under strip tension and to center the strip as far as the rolling stand.

12. The apparatus according to claim 11, wherein the flatness-measuring device operable for recording flatness measured values is arranged in a plane which is transverse with respect to the conveying direction of the metal strip.

13. The apparatus according to claim 11, wherein the flatness-measuring device comprises a flatness-measuring roller, a device operable for optically recording shape or a device for recording other inhomogeneities in strip surface properties.

14. The apparatus according to claim 11, further comprising signal lines connected to the evaluation device for transmitting control variables to at least one of the following actuating devices for influencing the roll nip in the rolling stands:

a bending block for working roll bending, a working roll displacement device, a heating/cooling device for zoned thermal influencing of the roll barrel, and a heating/cooling device for at least zoned thermal influencing of the metal strip.

15. The apparatus according to claim 11, further comprising signal lines connecting the evaluation device to at least one of the following actuating devices operable for influencing the surface profile of the casting roll:

a heating/cooling device operable for zoned thermal influencing of the casting roll barrel, a hydraulically actuable deformation device at the casting roll operable for applying radially acting deformation forces, a gas purge device operable for zoned influencing of the strand shell solidification conditions at the casting roll barrel, a coating device operable for zoned coating of the casting roll barrel with a coating agent which influences the heat transfer or the nucleation density in order to influence the strand shell solidification conditions, and a cleaning device operable for zoned cleaning of the casting roll barrel for zoned influencing of the strand shell solidification conditions at the casting roll barrel.

16. The apparatus according to claim 11, further comprising a temperature-measuring device operable for recording the temperature profile of the metal strip and arranged at least in front of or behind at least one rolling stand of the rolling installation, in a plane which lies transversely with respect to the conveying direction of the metal strip, and an evaluation device for the temperature-measuring device operable for recording and converting the measured values.

17. The apparatus according to claim 16, wherein the temperature-measuring device is arranged upstream of the rolling installation, and signal lines connecting the evaluation device for transmitting control variables to the strip-heating device or strip-cooling device, in order to make the temperature profile more uniform.

18. The apparatus according to claim 11, further comprising a strip thickness profile measuring device operable for determining the strip thickness profile and arranged in a plane lying transversely with respect to the conveying direction of the metal strip, and an evaluation device operable for recording and converting the measured values of the strip thickness measuring device.

19. The apparatus according to claim 18, further signal lines comprising connecting the evaluation device and operable for transmitting control variables to at least one of the following actuating devices operable for influencing the strip thickness profile in the rolling stands:

a working roll adjustment device, a bending block for working roll bending, a working roll displacement device, and a heating/cooling device for zoned thermal influencing of the roll barrel.

20. The apparatus according to claim 18, further comprising signal lines connecting the evaluation device to at least one of the following actuating devices operable for influencing the strip thickness profile by means of the casting roll:

a casting roll adjustment device, a heating/cooling device operable for zoned thermal influencing of the casting roll barrel, a hydraulically actuable deformation device at the casting roll operable for applying radially acting deformation forces, a gas purge device operable for zoned influencing of the strand shell solidification conditions at the casting roll barrel, a coating device operable for zoned coating of the casting roll barrel with a coating agent which influences the heat transfer or the nucleation density in order to influence the strand shell solidification conditions, and a cleaning device operable for zoned cleaning of the casting roll barrel for zoned influencing of the strand shell solidification conditions at the casting roll barrel.

21. The apparatus according to claim 11, wherein the roll-casting device further comprises two casting rolls driven in rotation, and two side plates, which together with the casting rolls form a melt space for holding metal melt and defining a casting gap for forming a cross-sectional format of a cast metal strip.

22. The process according to claim 5, further comprising influencing the surface profile of the casting roll by at least one of the following measures:

heating/cooling for zoned thermal influencing of the casting roll barrel by means of a heating/cooling device;

applying radially acting deformation forces at the casting roll by a hydraulically actuable deformation device;

applying a gas for zoned influencing of the strand shell solidification conditions at the casting roll barrel by means of a gas purge device;

applying a zoned coating of the casting roll barrel with a coating agent which influences the heat transfer or the nucleation density in order to influence the strand shell solidification conditions by means of a coating device; and zoned cleaning of the casting roll barrel for zoned influencing of the strand shell solidification conditions at the casting roll barrel by means of a cleaning device.

* * * * *